US011085187B2

(12) United States Patent
Grubka et al.

(10) Patent No.: US 11,085,187 B2
(45) Date of Patent: Aug. 10, 2021

(54) SHINGLE WITH ABRADED NAIL LINE

(71) Applicant: Owens Corning Intellectual Capital, LLC, Toledo, OH (US)

(72) Inventors: Lawrence J. Grubka, Concord, NC (US); Jay D. Beck, Mt. Vernon, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 17/022,351

(22) Filed: Sep. 16, 2020

(65) Prior Publication Data

US 2021/0108415 A1 Apr. 15, 2021

Related U.S. Application Data

(60) Provisional application No. 62/915,163, filed on Oct. 15, 2019.

(51) Int. Cl.

| | |
|---|---|
| ***E04D 1/26*** | (2006.01) |
| ***E04D 1/20*** | (2006.01) |
| ***E04D 1/28*** | (2006.01) |
| *E04D 1/00* | (2006.01) |

(52) U.S. Cl.

CPC ..... *E04D 1/26* (2013.01); *E04D 1/20* (2013.01); *E04D 1/28* (2013.01); *E04D 2001/005* (2013.01)

(58) Field of Classification Search

CPC .... E04D 1/26; E04D 1/20; E04D 1/28; E04D 2001/005

See application file for complete search history.

(56) References Cited

U.S. PATENT DOCUMENTS

| | | | | |
|---|---|---|---|---|
| 3,050,908 | A | 8/1962 | Schenk | |
| 5,950,387 | A | 9/1999 | Stahl et al. | |
| 6,145,265 | A * | 11/2000 | Malarkey | E04D 1/26 52/555 |
| 7,475,516 | B2 | 1/2009 | Jolitz et al. | |
| 7,836,654 | B2 | 11/2010 | Belt et al. | |
| 8,136,322 | B2 | 3/2012 | Shadwell et al. | |
| 8,240,100 | B2 | 8/2012 | Kalkanoglu et al. | |
| 8,813,453 | B2 | 8/2014 | Kalkanoglu et al. | |
| 8,984,835 | B2 | 3/2015 | Kalkanoglu et al. | |
| 10,947,729 | B2 * | 3/2021 | Collins | E04D 1/20 |

OTHER PUBLICATIONS

IKO The Shingles Expert, "Proper nailing is essential to the performance of roofing shingles," 12 pages, Oct. 10, 2017, downloaded from https://www.iko.be/en/blog/proper-nailing-essential-performance-roof-shingles.

* cited by examiner

*Primary Examiner* — Adriana Figueroa

(74) *Attorney, Agent, or Firm* — Calfee, Halter & Griswold LLP

(57) ABSTRACT

A roofing shingle includes a visible region for guiding an installer on proper placement of fasteners that secure the shingle to a surface. The visible region is formed by abrading material from the shingle.

20 Claims, 6 Drawing Sheets

SHINGLE WITH ABRADED NAIL LINE

CROSS-REFERENCE TO RELATED APPLICATIONS

This application claims priority to and the benefit of U.S. Provisional Application No. 62/915,163, filed Oct. 15, 2019, the entire content of which is incorporated by reference herein.

FIELD

The general inventive concepts relate to roofing shingles and, more particularly, to a roofing shingle with an abraded region indicating a nail zone of the shingle.

BACKGROUND

Asphalt-based roofing materials, such as roofing shingles, roll roofing and commercial roofing, are installed on the roofs of buildings to provide protection from the elements, and to give the roof an aesthetically pleasing look. Typically, the roofing material is constructed of a substrate such as a glass fiber mat or an organic felt, an asphalt coating on the substrate, and a surface layer of granules embedded in the asphalt coating.

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective and decorative surface granules onto portions of the asphalt sheet material.

In certain types of shingles, it is especially desired that the shingles define a sufficiently wide area, often known in the industry as the "nail zone," in order to make installation of roofs using shingles, such as laminated shingles, more efficient and secure. One or more lines or other indicia painted or otherwise marked longitudinally on the surface of the shingle may define such a nail zone. It is especially desired that the shingles define a nail zone that allows the installers to have some latitude in the nail placement.

For example, as described in U.S. Pat. No. 7,836,654, the entire disclosure of which is incorporated herein by reference, a reinforcement member may be used to delineate the nail zone.

Referring now to FIG. 1, a conventional laminated roofing shingle is shown generally at 100. In the illustrated embodiment, the shingle 100 includes an overlay sheet 102 attached to an underlay sheet 104 and has a first end 100A and a second end 100B. The shingle 100 also includes a longitudinal axis A. The overlay sheet 102 may include a headlap portion 106 and a tab portion 108. The headlap portion 106 may include a lower zone 106A and an upper zone 106B. The tab portion 108 defines a plurality of tabs 110 and cutouts 112 between adjacent tabs 110. In the illustrated embodiment, the tab portion 108 includes four tabs 110, although any suitable number of tabs 110 may be provided. The headlap portion 106 and the tabs 110 may include one or more granule patterns thereon. Each cutout 112 has a first height H1. In the illustrated embodiment, the cutouts 112 are shown as having the same height H1. It will be understood however, that each cutout 112 may be of different heights. A line B is collinear with an upper edge 112A of the cutouts 112 and defines an upper limit of an exposed region 114 of the underlay sheet 104. In the illustrated embodiment, the height of the exposed region 114 is equal to the first height H1, although the height of the exposed region 114 may be any desired height, and the top of the cutouts need not be collinear as shown. In a shingle wherein the cutouts 112 have different heights, the line B may be collinear with an upper edge 112A of the cutout 112 having the largest height. In the illustrated embodiment, the overlay sheet 102 has a second height H2.

A reinforcement tape 120 may be disposed longitudinally on the headlap portion 106. In the illustrated embodiment, the tape 120 extends longitudinally from the first end 100A to the second end 100B of the shingle 100 within the lower zone 106A of the headlap portion 106. A lower edge 120A of the tape 120 may be spaced apart from the line B by a distance D1, and an upper edge 120B of the tape 120 may be spaced apart from the line B by a distance D2. In one embodiment, the distance D1 is within the range of from about ¼ inch to about ¾ inch. In another embodiment, the distance D1 is about ½ inch. In one embodiment, the distance D2 is within the range of from about 1¾ inches to about 2¼ inches. In another embodiment, the distance D2 is about 2 inches. The distances D1 and D2 may, however, be of any other desired length, including zero for D1. For example, if desired, the tape 120 may substantially cover the entire headlap portion 106 of the overlay sheet 102. It will be further understood, however, that one or more additional lengths of tape may be disposed longitudinally on the headlap portion 106, even outside the nail zone, such as shown by the phantom line 120'. It will be understood that the reinforcement material need not extend from the first end 100A to the second end 100B of the shingle 100, and may be disposed in one or more sections or portions on the shingle 100.

The tape 120 defines a nail zone 122 and may include text such as "NAIL HERE •", as shown in FIG. 1. It will be understood, however, that any other text or other indicia may be included on the tape 120. It will also be understood that the tape 120 can be provided without such text or indicia. Such indicia on the tape 120 ensures that the nail zone 122 may be easily and quickly identified by the shingle installer.

In the embodiment illustrated in FIG. 1, the underlay sheet 104 includes a leading edge 104A and a trailing edge 104B and has a third height H3. In the illustrated embodiment, the trailing edge 104B of the underlay sheet 104 is spaced apart from the line B by a distance D3. As shown, the distance D3 is about ⅜ inch, however, the distance D3 may be any desired distance.

In the illustrated embodiment, the third height H3 of the underlay sheet 104 is less than one-half the second height H2 of the overlay sheet 102. The overlay sheet 102 and the underlay sheet 104 thereby define a two-layer portion of the laminated shingle 100 and a single-layer portion of the laminated shingle 100, wherein at least a portion of the tape 120 is preferably adhered to the single-layer portion of the laminated shingle 100. Alternately, the third height H3 of the underlay sheet 104 may be equal to one-half the second height H2 of the overlay sheet 102, or greater than one-half of the second height H2 of the overlay sheet 102. Such a relationship between the underlay sheet 104 and the overlay sheet 102 allows the tape 120 to be positioned such that a reinforced nail zone is provided at a substantially single-layer portion of the shingle 100.

A diagram of another conventional laminated roofing shingle 200 is shown in FIG. 2. The shingle 200 has a construction similar to that of the shingle 100, albeit with a simpler form of indicia showing the nail zone.

The shingle 200 has a rectangular profile that extends from a first side 202 to a second side 204 and between a top side 206 and a bottom side 208 to define an upper face 210 and a lower face (not shown). The shingle 200 includes an overlay sheet 212 attached to an underlay sheet 214. The overlay sheet 212 includes a headlap portion 216 and a tab portion 218. The tab portion 218 defines a plurality of tabs 222 and cutouts 224 between adjacent tabs 222. The headlap portion 216 and the tabs 222 may include one or more granule patterns 226 thereon.

As shown in FIG. 2, a nail zone 230 of the shingle 200 is indicated by a line 232 that is painted in the headlap portion 216 of the shingle 200. The paint forming the line 232 is applied by a wheel that rolls across the shingle 200 to deposit the paint thereon. The width of the line 232 is typically in the range of ⅛ inch to 1/16 inch. Given the properties of the paint and the surface texture of the shingle 200, the quality of the line 232 may vary from one shingle to the next. Furthermore, to better indicate the nail zone 230, increasing the width of the line 232 was contemplated. However, because of properties of the paint (e.g., surface tension, solids content), increasing the width of the line 232 in a manner that provides consistent results presents challenges.

In view of the above, there is an unmet need for a technique of applying indicia to a shingle (to denote a nail zone of the shingle) that overcomes the drawbacks of conventional approaches.

SUMMARY

The general inventive concepts relate to a shingle that is physically altered to produce nail zone indicia thereon. More specifically, a surface coating of granules on the shingle is at least partially removed (e.g., via abrasion) to create indicia for a nail zone of the shingle.

In one exemplary embodiment, a laminated roofing shingle comprises an underlay sheet and an overlay sheet bonded to the underlay sheet. The overlay sheet includes a headlap portion and a tab portion. The tab portion comprises a plurality of tabs and a plurality of cutouts. The headlap portion includes an abraded region corresponding to at least a portion of a nail zone of the shingle.

In some exemplary embodiments, the laminated roofing shingle further comprises first granules disposed in the headlap portion, wherein the first granules in the abraded region of the headlap portion have been modified relative to the first granules outside of the abraded region.

In some exemplary embodiments, the laminated roofing shingle further comprises second granules disposed in the tab portion.

In some exemplary embodiments, the laminated roofing shingle has a rectangular profile that extends from a first side to a second side and between a top side and a bottom side to define an upper face and a lower face.

In some exemplary embodiments, the laminated roofing shingle has a first width measured from the top side to the bottom side, the nail zone has a second width, and the second width is substantially smaller than the first width. In some exemplary embodiments, the first width is at least eight times greater than the second width.

In some exemplary embodiments, the abraded region has a third width and the second width equals the third width.

In some exemplary embodiments, the abraded region has a third width and the second width is greater than the third width.

In some exemplary embodiments, the shingle has a first length measured from the first side to the second side, the nail zone has a second length, and the first length equals the second length.

In some exemplary embodiments, the abraded region has a third length and the third length equals the second length.

In some exemplary embodiments, the abraded region has a third length and the third length is less than the second length.

In some exemplary embodiments, the abraded region includes a plurality of abraded segments, each of the segments having a fourth length, wherein the second length is at least four times larger than the fourth length.

In some exemplary embodiments, the abraded region includes a plurality of abraded segments, each of the segments having a fourth length, wherein the second length is at least ten times larger than the fourth length.

In some exemplary embodiments, the abraded region comprises a first abraded region and a second abraded region, wherein the first abraded region and the second abraded region are parallel to one another, wherein the first abraded region is closer to the top side than the bottom side, wherein the second abraded region is closer to the bottom side than the top side, wherein a gap separates the first abraded region and the second abraded region, wherein the first abraded region has a third width, wherein the second abraded region has a fourth width, and wherein the gap has a fifth width.

In some exemplary embodiments, the third width equals the fourth width.

In some exemplary embodiments, the fifth width is greater than the sum of the third width and the fourth width.

In some exemplary embodiments, the second width equals the sum of the third width, the fourth width, and the fifth width.

In some exemplary embodiments, the second width is greater than the sum of the third width, the fourth width, and the fifth width.

In one exemplary embodiment, a method of forming a laminated roofing shingle comprises providing an underlay sheet; providing an overlay sheet having a headlap portion and a tab portion; depositing a plurality of first granules on the headlap portion; depositing a plurality of second granules on the tab portion; adhering the overlay sheet to the underlay sheet; and removing at least a portion of a surface coating from at least a portion of the first granules to form an abraded region. In general, the abraded region visibly indicates a nail zone of the shingle.

In some exemplary embodiments, the abraded region is a continuous line extending a length of the shingle.

In some exemplary embodiments, the abraded region is a discontinuous line comprising a plurality of abraded segments.

In some exemplary embodiments, the abraded region comprises a first abraded line and a second abraded line separated by a gap. In some exemplary embodiments, at least one of the first abraded line and the second abraded line extends a length of the shingle.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described herein.

The general inventive concepts encompass shingles that are physically altered to produce nail zone indicia thereon. More specifically, a surface coating of granules on a shingle is at least partially removed (e.g., via abrasion) to create indicia for a nail zone of the shingle.

Figure 1:
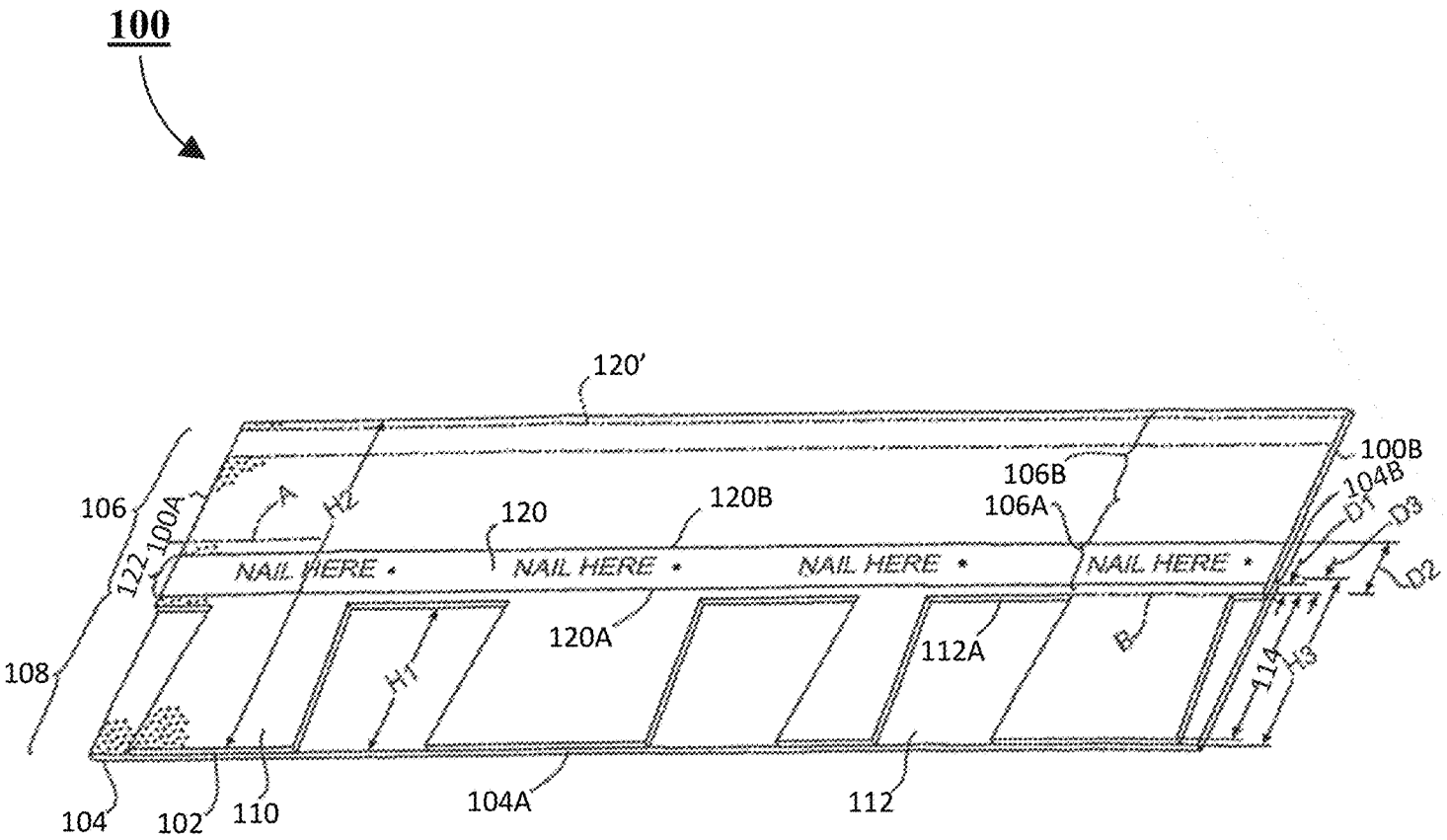
FIG. 1 PRIOR ART
FIG. 1 is a perspective view of a conventional laminated shingle using a reinforcement member as indicia for a nail zone of the shingle.
Figure 2:
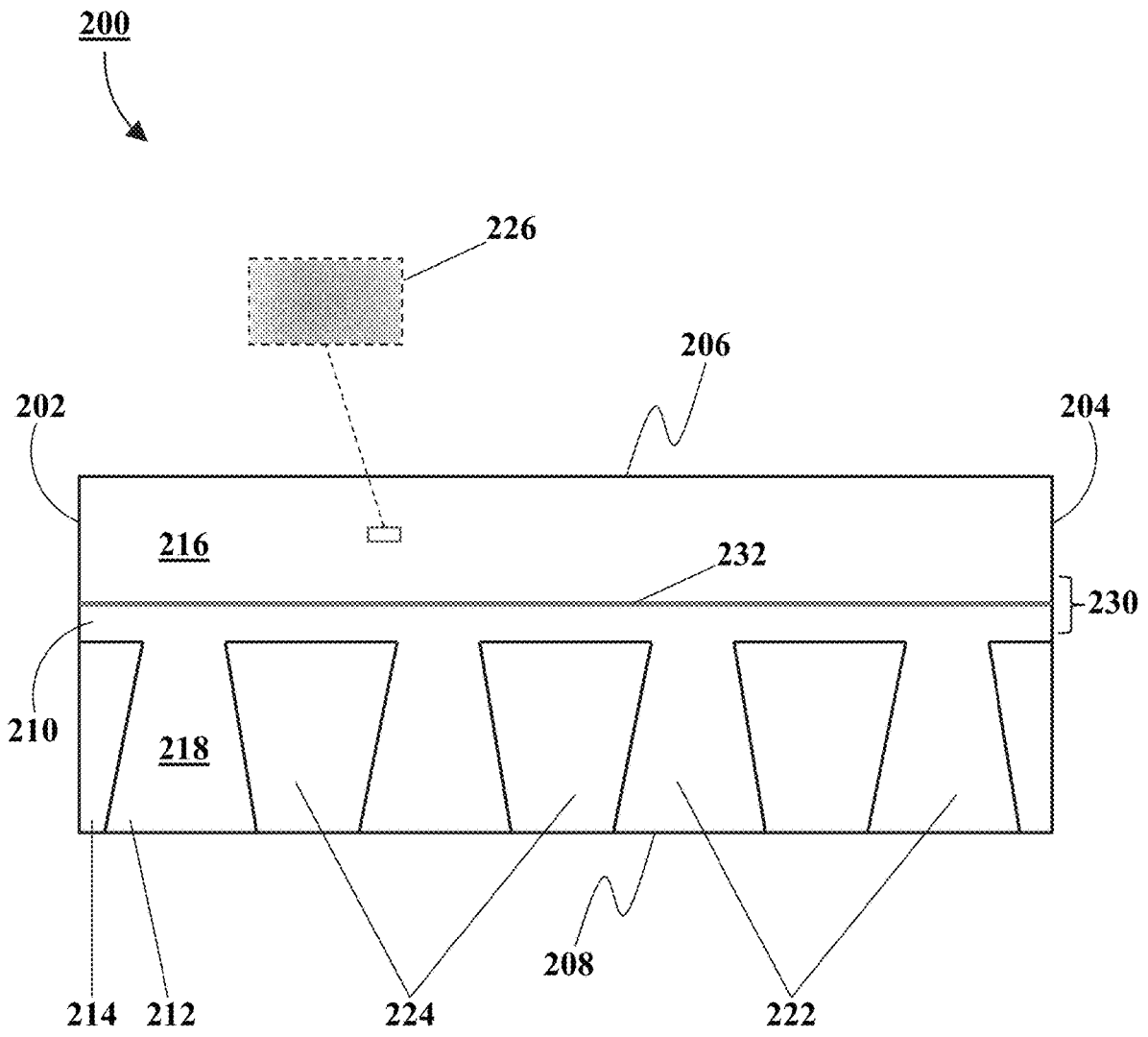
FIG. 2 PRIOR ART
FIG. 2 is a top plan view of a conventional laminated shingle using a painted line as indicia for a nail zone of the shingle.
Figure 3:
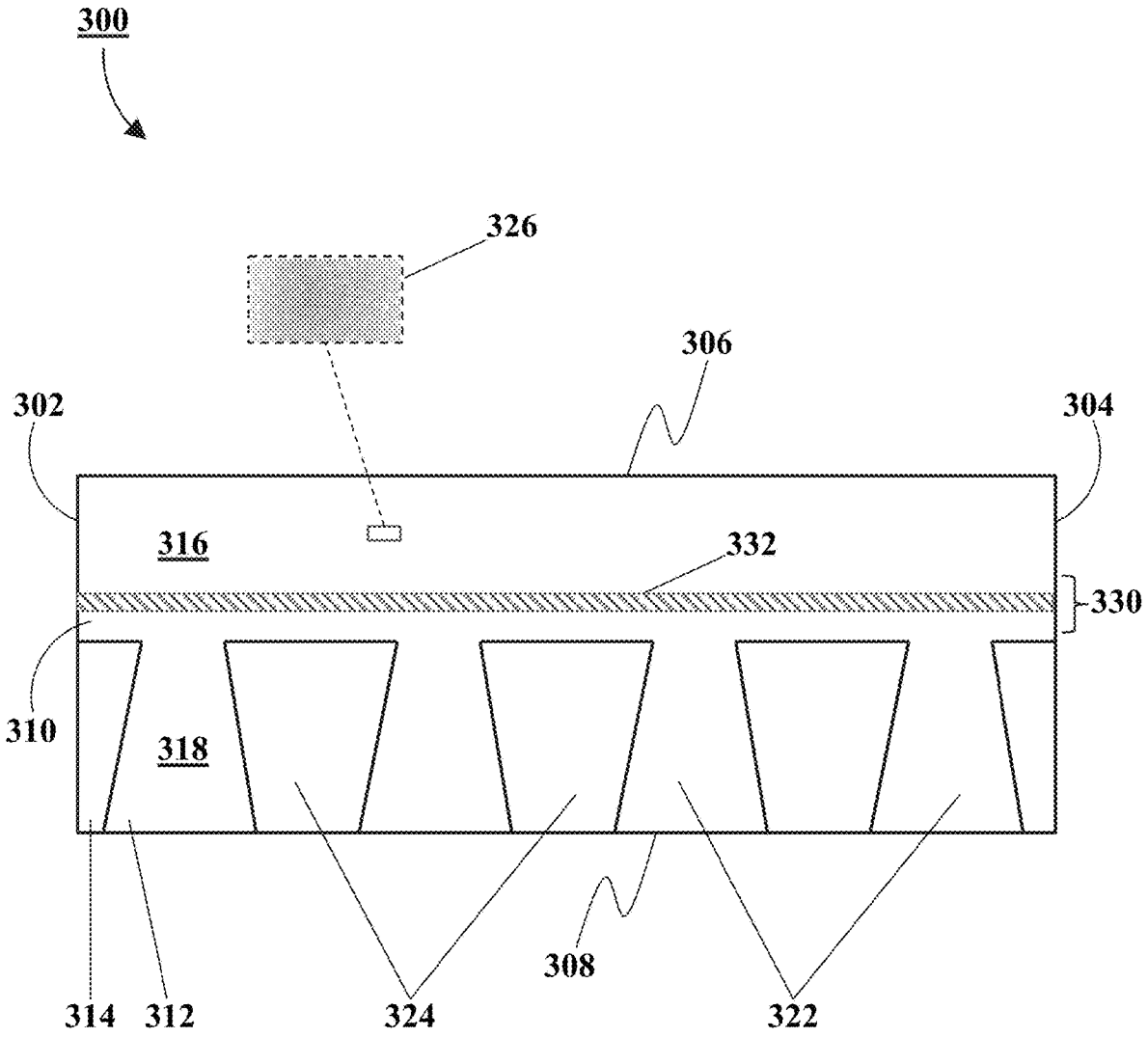
FIG. 3 is a top plan view of a laminated shingle with a continuous abraded line as indicia for a nail zone of the shingle, according to an exemplary embodiment.

A laminated roofing shingle 300, according to one exemplary embodiment, is shown in FIG. 3. The shingle 300 can have a construction similar to the shingles 100, 200.

The shingle 300 has a rectangular profile that extends from a first side 302 to a second side 304 and between a top side 306 and a bottom side 308 to define an upper face 310 and a lower face (not shown). The shingle 300 includes an overlay sheet 312 attached to an underlay sheet 314. The overlay sheet 312 includes a headlap portion 316 and a tab portion 318. The tab portion 318 defines a plurality of tabs 322 and cutouts 324 between adjacent tabs 322. The headlap portion 316 and the tabs 322 may include one or more granule patterns 326 thereon.

As shown in FIG. 3, the shingle 300 includes a nail zone 330. The nail zone 330 typically overlaps a common bond portion of the shingle 300, where the sheets 312, 314 overlap. The nail zone 330 typically extends a length of the shingle 300 from the first side 302 to the second side 304. The nail zone 330 has a width $w_1$, situated between the top side 306 and the bottom side 308. The nail zone 330 helps an installer visibly identify the portion of the shingle 300 through which fasteners (e.g., nails) should be installed to anchor the shingle 300 to a roof deck.

Figure 4:
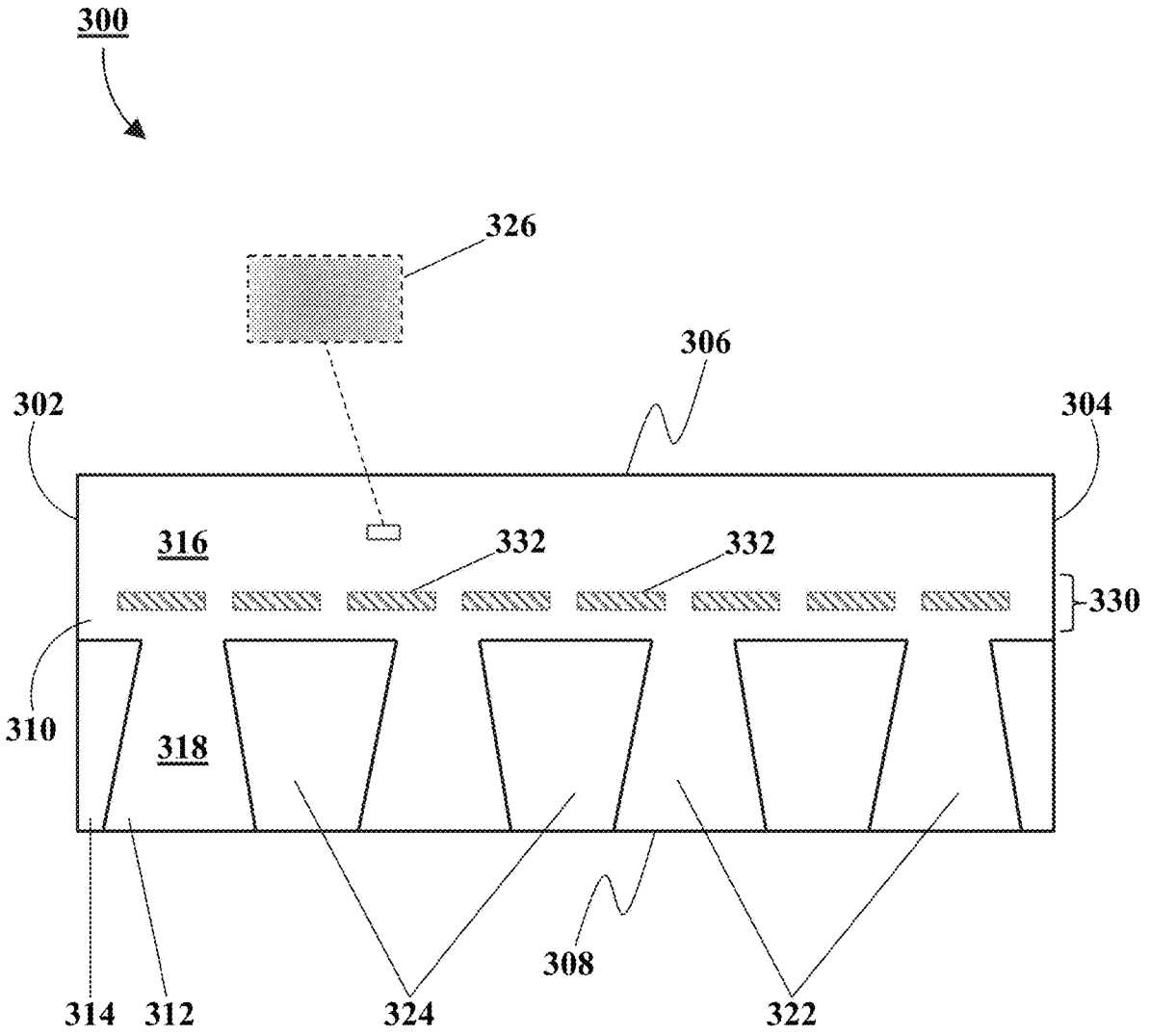
FIG. 4 is a top plan view of a laminated shingle with a discontinuous abraded line as indicia for a nail zone of the shingle, according to an exemplary embodiment.

To aid in identification of the nail zone 330, the shingle 300 is modified so that the nail zone 330 has a different appearance than other portions of the shingle 300. In particular, the shingle is abraded to form a line 332 within the nail zone 330. The line 332 typically extends a length of the shingle 300 from the first side 302 to the second side 304. The line 332 has a width $w_2$, situated between the top side 306 and the bottom side 308. In some exemplary embodiments, the line 332 is continuous, as shown in FIG. 3. In some exemplary embodiments, the line 332 is discontinuous, as shown in FIG. 4.

The shingle 300 can be abraded in any manner suitable to remove a portion of the shingle 300 (e.g., at least a portion of the surface coating of granules within the nail zone 330). For example, a moving disk, wheel, belt, or the like with an abrasive surface can be used to form the line 332 within the nail zone 330. The abraded portion of the shingle 300 (i.e., the line 332) will have a different appearance than those adjacent portions of the shingle 300 that are unabraded. Consequently, the line 332 represents a form of nail zone indicia that can be readily and consistently applied to the shingle 300, without requiring application of any additional material (e.g., paint) or component (e.g., reinforcing tape).

Figure 5:
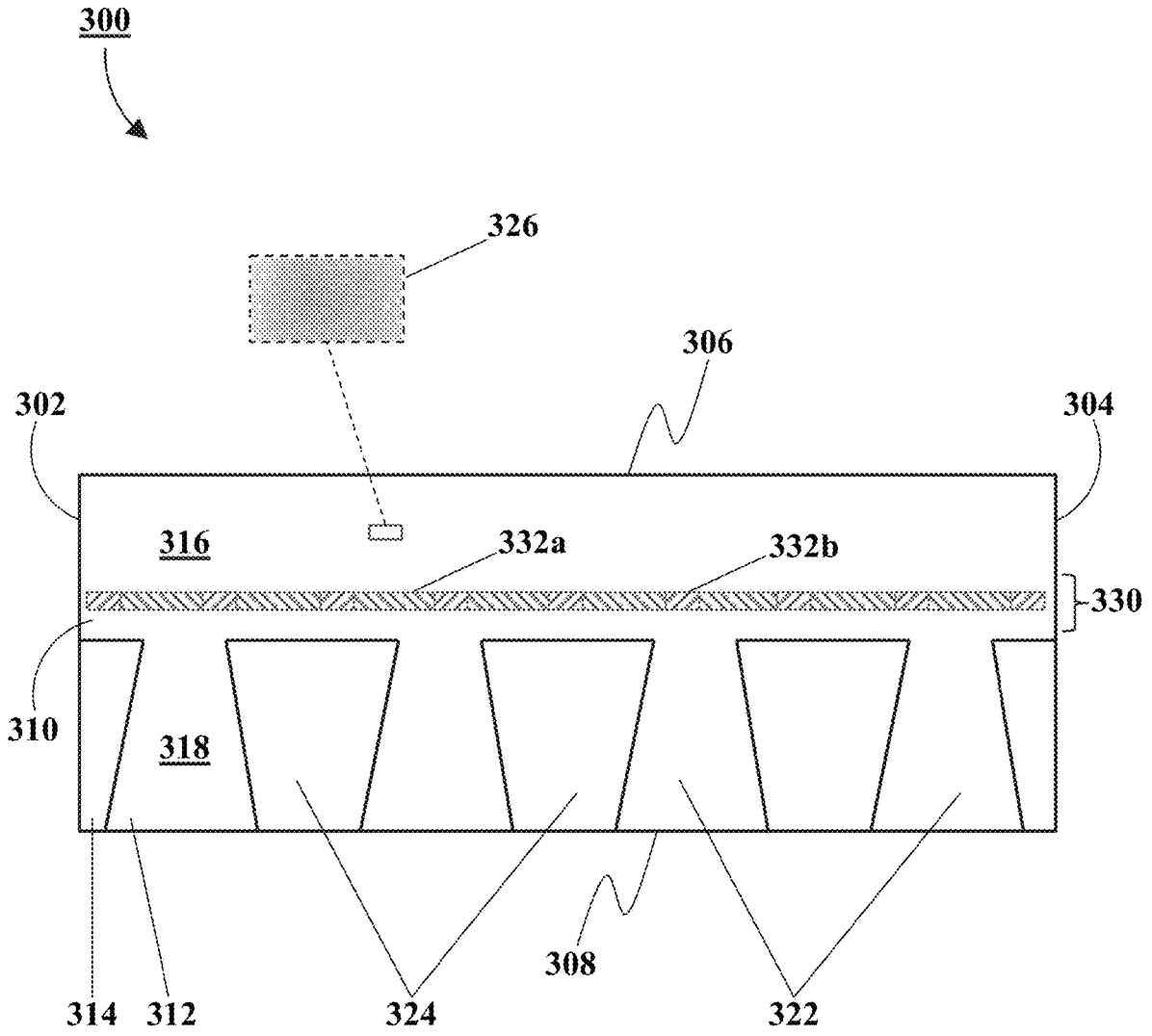
FIG. 5 is a top plan view of a laminated shingle with an abraded line having different textures as indicia for a nail zone of the shingle, according to an exemplary embodiment.

Additionally, in some exemplary embodiments, the abraded portion of the line 332 can have a different texture 332*a* than a texture 332*b* of those adjacent portions of the line 332 that are unabraded, thereby providing a tactile indication of the nail zone 330 and/or indication of areas in the nail zone 330 representing particularly suitable positions for placements of fasteners, as shown in FIG. 5. One manner of imparting the different textures 332*a*, 332*b* could involve the depth of abrasion of the respective regions of the line 332.

In some exemplary embodiments, the width $w_2$ is greater than ⅛ inch. In some exemplary embodiments, the width $w_2$ is equal to the width $w_1$. In some exemplary embodiments, the width $w_2$ is at least ½ of the width $w_1$.

Preferably, but not necessarily, the abrasion process occurs in-line during production of the shingle 300.

Figure 6:
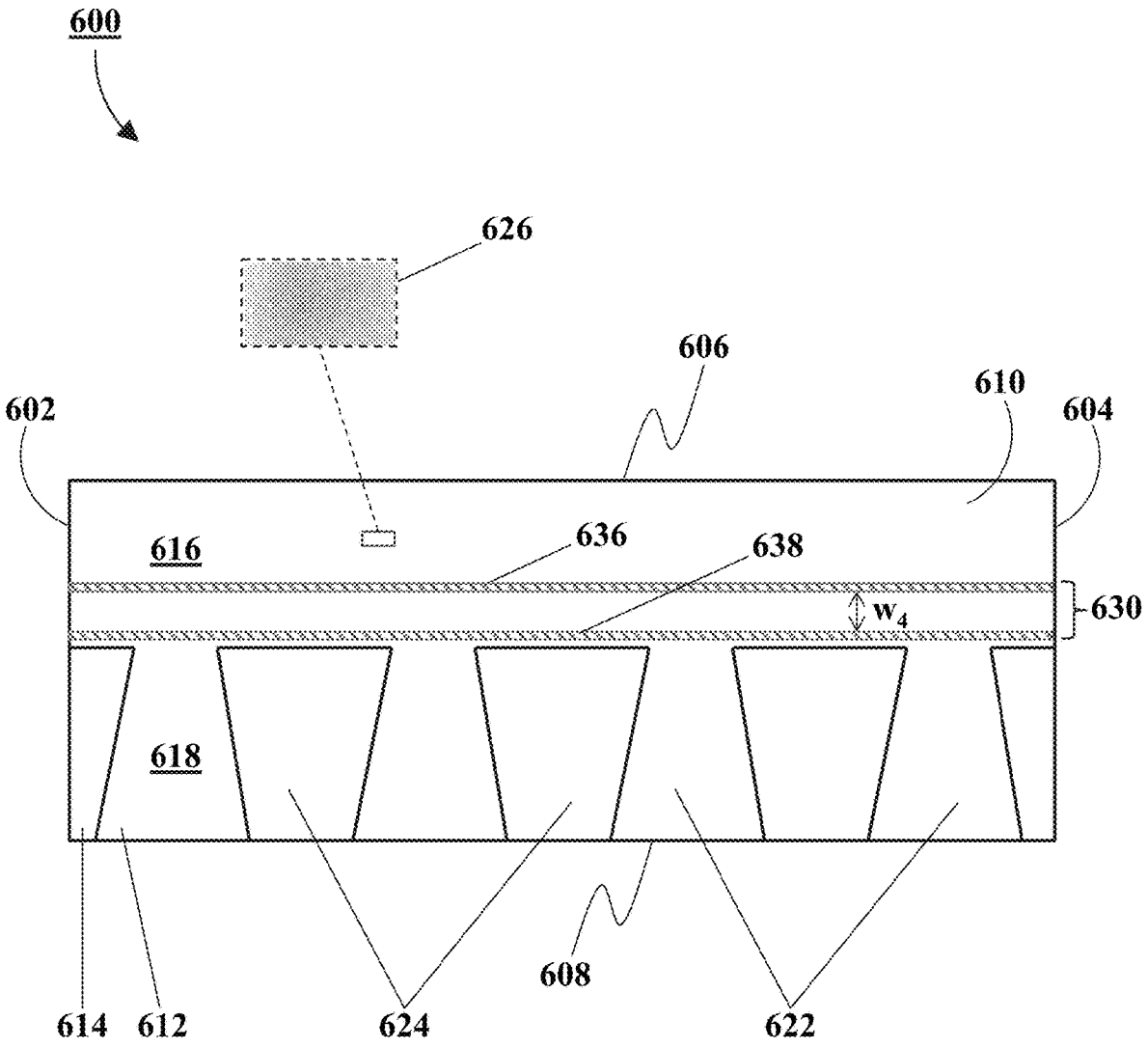
FIG. 6 is a top plan view of a laminated shingle with a pair of continuous abraded lines as indicia for a nail zone of the shingle, according to an exemplary embodiment.

A laminated roofing shingle 600, according to one exemplary embodiment, is shown in FIG. 6. The shingle 600 can have a construction similar to the shingles 100, 200.

The shingle 600 has a rectangular profile that extends from a first side 602 to a second side 604 and between a top side 606 and a bottom side 608 to define an upper face 610 and a lower face (not shown). The shingle 600 includes an overlay sheet 612 attached to an underlay sheet 614. The overlay sheet 612 includes a headlap portion 616 and a tab portion 618. The tab portion 618 defines a plurality of tabs 622 and cutouts 624 between adjacent tabs 622. The headlap portion 616 and the tabs 622 may include one or more granule patterns 626 thereon.

As shown in FIG. 6, the shingle 600 includes a nail zone 630. The nail zone 630 typically overlaps a common bond portion of the shingle 600, where the sheets 612, 614 overlap. The nail zone 630 typically extends a length of the shingle 600 from the first side 602 to the second side 604. The nail zone 630 has a width $w_1$, situated between the top side 606 and the bottom side 608. The nail zone 630 helps an installer visibly identify the portion of the shingle 600 through which fasteners (e.g., nails) should be installed to anchor the shingle 600 to a roof deck.

To aid in identification of the nail zone 630, the shingle 600 is modified so that the nail zone 630 has a different appearance than other portions of the shingle 600. In particular, the shingle is abraded to form a first line 636 and a second line 638 within or directly abutting the nail zone 630. The lines 636, 638 typically extend a length of the shingle 600 from the first side 602 to the second side 604. The lines 636, 638 are substantially parallel to one another. The first line 636 has a width $w_2$, situated between the top side 606 and the bottom side 608. The second line 638 has a width $w_3$, situated between the top side 606 and the bottom side 608. The space between the lines 636, 638 has a width $w_4$, as shown in FIG. 6. The first line 636 is closer to the top side 606 than the bottom side 608. The second line 638 is closer to the bottom side 608 than the top side 606. In some exemplary embodiments, one or more of the lines 636, 638 are continuous, as shown in FIG. 3. In some exemplary embodiments, one or more of the lines 636, 638 are discontinuous.

The shingle 600 can be abraded in any manner suitable to remove a portion of the shingle 600 (e.g., at least a portion of the surface coating of granules within the nail zone 630). For example, a moving disk, wheel, belt, or the like with an abrasive surface can be used to form the lines 636, 638 within the nail zone 630. In some exemplary embodiments, the first line 636 is formed and then the second line 638 is formed. In some exemplary embodiments, the lines 636, 638 are formed at the same time. The abraded portion of the shingle 600 (i.e., the lines 636, 638) will have a different appearance than those adjacent portions of the shingle 600 that are unabraded. Consequently, the lines 636, 638 represent a form of nail zone indicia that can be readily and consistently applied to the shingle 600, without requiring application of any additional material (e.g., paint) or component (e.g., reinforcing tape).

In some exemplary embodiments, the width $w_2$ is greater than ⅛ inch. In some exemplary embodiments, the width $w_3$ is greater than ⅛ inch. In some exemplary embodiments, the width $w_2$ is equal to the width $w_3$. In some exemplary embodiments, the width $w_2$ is not equal to the width $w_3$. In some exemplary embodiments, the width $w_4$ is greater than $w_2+w_3$. In some exemplary embodiments, the width $w_1$ is equal to the $w_2+w_3+w_4$.

Preferably, but not necessarily, the abrasion process occurs in-line during production of the shingle 600.

The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications to the devices and systems disclosed. For example, while various exemplary embodiments are described herein that involve physical abrasion of a shingle, other types of abrasion (e.g., chemical, thermal) may also be suitable. As another example, while various exemplary embodiments are described herein that involve abrasion in a linear manner, other shapes and or patterns of abrasion may also be suitable. It is sought, therefore, to cover all such changes and modifications as fall within the spirit and scope of the general inventive concepts, as described and/or claimed herein, and any equivalents thereof.

What is claimed is:

1. A laminated roofing shingle comprising:

an underlay sheet; and an overlay sheet bonded to the underlay sheet, wherein the overlay sheet includes a headlap portion and a tab portion, wherein the tab portion comprises a plurality of tabs and a plurality of cutouts, wherein the headlap portion includes an abraded region corresponding to at least a portion of a nail zone of the shingle.

2. The laminated roofing shingle of claim 1, further comprising first granules disposed in the headlap portion, and wherein the first granules in the abraded region of the headlap portion have been modified relative to the first granules outside of the abraded region.

3. The laminated roofing shingle of claim 2, further comprising second granules disposed in the tab portion.

4. The laminated roofing shingle of claim 1, wherein the shingle has a rectangular profile that extends from a first side to a second side and between a top side and a bottom side to define an upper face and a lower face.

5. The laminated roofing shingle of claim 4, wherein the shingle has a first width measured from the top side to the bottom side, wherein the nail zone has a second width, and wherein the second width is smaller than the first width.

6. The laminated roofing shingle of claim 5, wherein the abraded region has a third width, and wherein the second width equals the third width.

7. The laminated roofing shingle of claim 5, wherein the abraded region has a third width, and wherein the second width is greater than the third width.

8. The laminated roofing shingle of claim 4, wherein the shingle has a first length measured from the first side to the second side, wherein the nail zone has a second length, and wherein the first length equals the second length.

9. The laminated roofing shingle of claim 8, wherein the abraded region has a third length, and wherein the third length equals the second length.

10. The laminated roofing shingle of claim 8, wherein the abraded region has a third length, and wherein the third length is less than the second length.

11. The laminated roofing shingle of claim 8, wherein the abraded region includes a plurality of abraded segments, each of the segments having a fourth length, and wherein the second length is at least four times larger than the fourth length.

12. The laminated roofing shingle of claim 8, wherein the abraded region includes a plurality of abraded segments, each of the segments having a fourth length, and wherein the second length is at least ten times larger than the fourth length.

13. The laminated roofing shingle of claim 5, wherein the abraded region comprises a first abraded region and a second abraded region, wherein the first abraded region and the second abraded region are parallel to one another, wherein the first abraded region is closer to the top side than the bottom side, wherein the second abraded region is closer to the bottom side than the top side, wherein a gap separates the first abraded region and the second abraded region, wherein the first abraded region has a third width, wherein the second abraded region has a fourth width, and wherein the gap has a fifth width.

14. The laminated roofing shingle of claim 13, wherein the third width equals the fourth width.

15. The laminated roofing shingle of claim 13, wherein the fifth width is greater than the sum of the third width and the fourth width.

16. The laminated roofing shingle of claim 13, wherein the second width equals the sum of the third width, the fourth width, and the fifth width.

17. The laminated roofing shingle of claim 13, wherein the second width is greater than the sum of the third width, the fourth width, and the fifth width.

18. A method of forming a laminated roofing shingle, the method comprising:

providing an underlay sheet;

providing an overlay sheet having a headlap portion and a tab portion;

depositing a plurality of first granules on the headlap portion;

depositing a plurality of second granules on the tab portion;

adhering the overlay sheet to the underlay sheet; and removing at least a portion of a surface coating from at least a portion of the first granules to form an abraded region, wherein the abraded region visibly indicates a nail zone of the shingle.

19. The method of claim 18, wherein the abraded region is one of a continuous line extending a length of the shingle and a discontinuous line comprising a plurality of abraded segments.

20. The method of claim 18, wherein the abraded region comprises a first abraded line and a second abraded line separated by a gap.

* * * * *